United States Patent [19]

Martin

[11] Patent Number: 4,905,826

[45] Date of Patent: Mar. 6, 1990

[54] GARMENT BAG HAVING TELESCOPING ROD

[76] Inventor: Eric J. Martin, 7928 Peyton Forest Trail, Annandale, Va. 22003

[21] Appl. No.: 259,515

[22] Filed: Oct. 18, 1988

[51] Int. Cl.[4] ..... B65D 85/18

[52] U.S. Cl. ..... 206/286; 206/279; 206/289; 190/15 R

[58] Field of Search ..... 206/280, 282, 283, 284, 206/285, 286, 287, 289, 290, 291, 279, 287.1; 223/40, 89, 94; 190/15 R

[56] References Cited

U.S. PATENT DOCUMENTS

| | | | |
|---|---|---|---|
| 1,438,737 | 12/1922 | Witbeck | 206/289 X |
| 1,981,510 | 11/1934 | Jones | 206/287 X |
| 2,072,685 | 4/1937 | Richter | 206/289 X |
| 2,476,932 | 7/1949 | Tucker | 190/41 |
| 2,645,541 | 7/1953 | Mintz et al. . | |
| 3,542,170 | 11/1970 | Bialo | 206/279 |
| 4,736,854 | 4/1988 | King et al. | 206/286 X |
| 4,782,947 | 11/1988 | Sheiman | 206/279 |

FOREIGN PATENT DOCUMENTS

| | | | |
|---|---|---|---|
| 675746 | 4/1939 | Fed. Rep. of Germany | 206/289 |
| 1089692 | 3/1955 | France | 206/286 |

OTHER PUBLICATIONS

Nov. 28, 1988 publication of the Wall Street Journal as advertised by Samsonite Corporation Samsonite's Ultravalet Garment Bag.

*Primary Examiner*—Stephen Marcus
*Assistant Examiner*—Christine Peterson

[57] ABSTRACT

A garment bag having a telescoping clothing rod. The rod in the garment bag may be extended outwardly parallel to a closet pole. A hook at the far end of the rod allows the rod to be hung from the closet pole. Once extended, clothing in the garment bag may be removed, by merely sliding the hangers along the rod. A large zippered opening is provided in side of the bag for easy removal of the clothing.

9 Claims, 1 Drawing Sheet

GARMENT BAG HAVING TELESCOPING ROD

BACKGROUND OF THE INVENTION

1. Field of the Invention:

This invention relates generally to a traveling garment bag and more specifically to a traveling garment bag having a telescoping rod for easy removal of clothing.

2. Discussion of the Background:

Travel garment bags have come into wide use as a replacement for a traditional suitcase. These garment bags differ from suitcases in that clothing is left on hangers and hung from a rod or hook near the top of the bag. While many different designs of such garment bags have been in use, they all require the necessity of placing the hangers into the bag when packing and the complete removal of the hangers individually when unpacking. There have been no designs for the easy removal and replacement of clothing into the bags.

U.S. Pat. No. 2,645,541 shows a garment bag with an extensible top support. This design presents two main problems. While the top support is extended, the garments are still stored in a space equal to the width of the original bag. It does not allow for each removal. The second problem arises from the awkwardness of the bag once the top support is extended. The increase uses up additional space while a portion of the original bag will not be usable.

Another similar patent is U.S. Pat. No. 1,981,510 which utilizes an extensible tie rack. While the design has some similarities to the present invention, it is limited to ties and not suitable for garment usage.

A third patent with comparable characteristics is U.S. Pat. No. 2,476,932. This is a traveling case with an extensible support for hangers. However, there are several disadvantages. Even when extended, space is limited to the width of the case. Rack section designated 16 becomes an obstacle when removing or replacing clothing and the rectangular shape of the case does not allow for hanging the case on a closet rod or hook.

SUMMARY OF THE INVENTION

Accordingly, one object of this invention is to provide a novel travel garment bag which simplifies the process of packing and unpacking of clothing.

Another object of this invention is to provide a novel travel garment bag having a telescoping rod.

Another object of this invention is to provide a travel garment bag with a telescoping rod which is simple in construction and relatively inexpensive to make.

Briefly, these and other objects of the invention are achieved by providing a telescoping rod within the garment bag onto which the hangers are placed when packing. When unpacking, the rod is merely telescoped out and hung from the closet pole so that the hangers may be unpacked by merely sliding the hangers along the rod.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
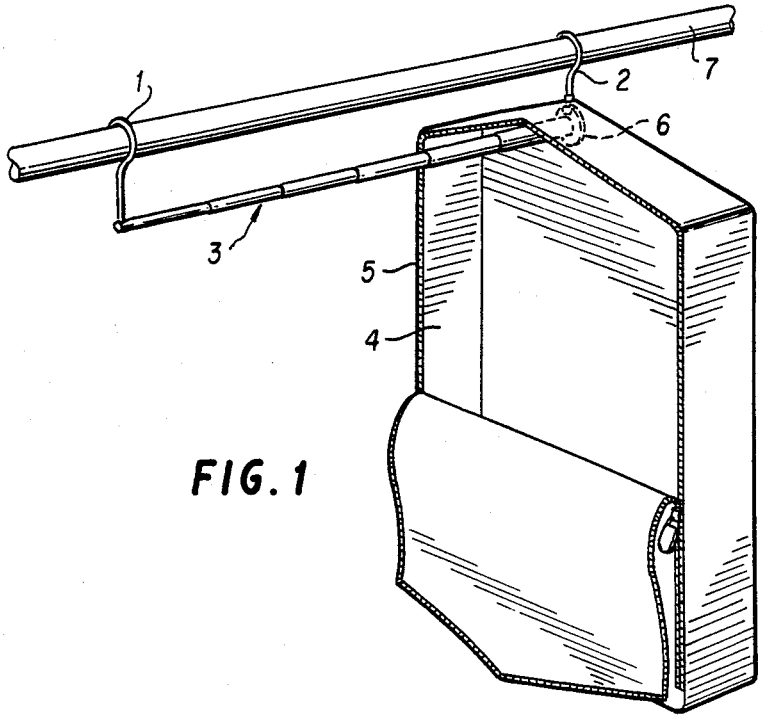
FIG. 1 shows a prospective view of the garment bag of the present invention.
Figure 2:
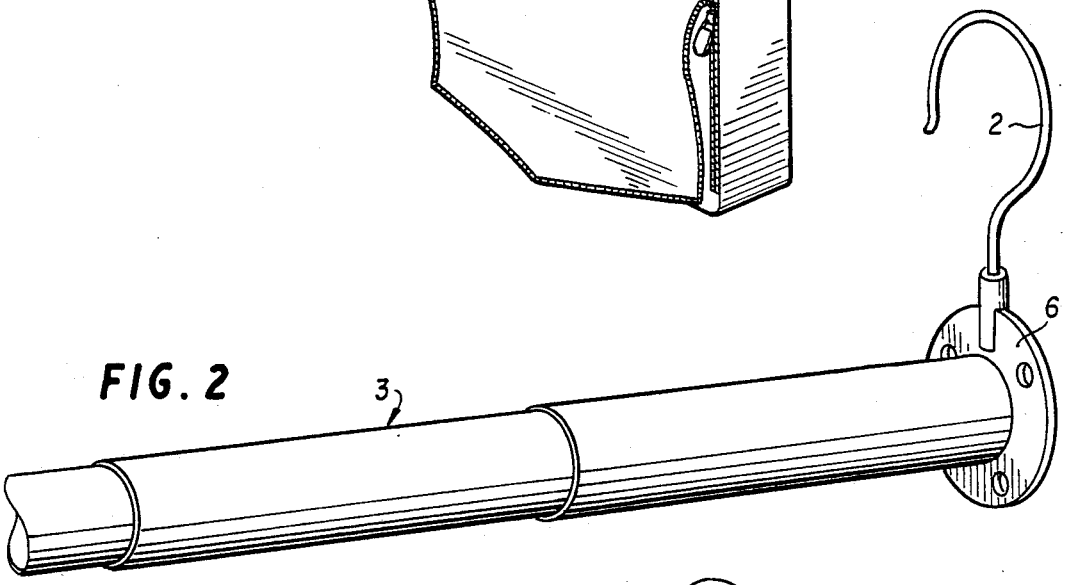
FIG. 2 is a closer prospective view of the rod and its mounting for the garment bag.

Various other objects, features and attendant advantages of the present invention will be more fully appreciated as the same becomes better understood from the following detailed description when considered in connection with the accompanying drawings in which like references characters designate like or corresponding parts throughout the several views and wherein FIG. 1 shows a prospective view of the garment bag with the rod in the extended position. The garment bag 4 has an elongated zipper 5 which allows the garment bag to be opened along substantially a complete side of the bag. This allows the clothing to be removed easily from the bag without touching the bag in the process.

A telescoping rod 3 is made in a series of sections which may be collapsed in the form of a telescope as is well known. A hook 1 is mounted on the far end of the rod. The other end of the rod is connected to a support 6 which is mounted on the closed side of the garment bag. This support may be connected to the bag itself if the bag material between the hook and the support is sufficiently strong.

Hook 1 at the far end of the rod is rotatable so that when the rod is collapsed the hook may be turned for easy entry into the bag.

In operation, a traveler may carry the bag to a traditional closet pole 7, place the hook 2 over the pole 7 in a traditional fashion; unzip zipper 5 and extend the rod 3 to the left. Hook 1 may be rotated in the process in order for it to easily be removed from the bag. Hook 1 is then also placed on the closet pole so that the far end of the rod is also supported. The clothing that is packed in the bag may then be removed merely by sliding the hangers along the rod toward hook 1. These may be left on rod 3 if desired or may be easily removed to closet pole 7 merely by lifting them up one at a time on the pole. When the traveler is ready to repack his clothes the procedure may be reversed with the hangers being pushed into the bag along rod 3 followed by the removal of hook 1 from the pole and the collapse of rod 3 into the bag.

Figure 3:
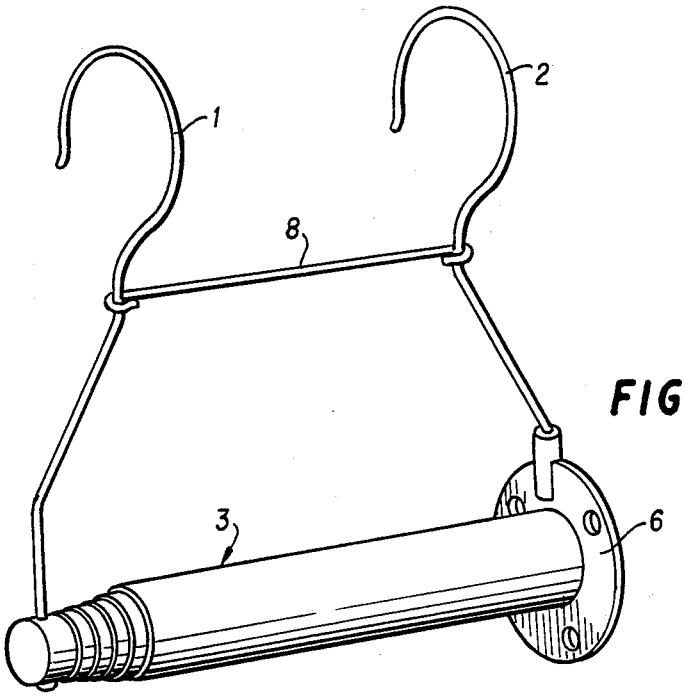
FIG. 3 is a side view of the extensible rod of the present invention in its closed position.

FIG. 3 shows the device in the closed position. In this position, hooks 1 and 2 are drawn together in such a manner as to enable a clip, 8, to slip onto hook 2. The other end of the clip is attached to hook 1. This stabilizes the two hooks to each other and better supports the far end of the rod when closed. The two hooks may be bent towards each other, as shown in FIG. 3 so that there is a decreased distance between the hooks, thus allowing clip 8 to be shortened and also giving more support to both ends of the rod.

In FIG. 3 support 6 is shown as an extension from the base of hook 2 and is sewn into the back wall of the garment bag. This lends additional support to the fixed end of the rod so that it will not pull away from the wall of the bag.

Obviously numerous modifications or variations of the present invention are possible in light of the above teachings. It is therefore to be understood that within the scope of the appended claims, the invention may be practiced otherwise and as specifically described herein.

What is claimed as new and desired to be secured by Letters Patent of the United States is:

1. A travel garment bag comprising:

a covering means for protecting the contents thereof and having a removable opening;

a telescoping rod connected to one wall of said covering means which, when collapsed fits within said covering means and which extends to have a length greater then the thickness of said garment bag;

attaching means connected to the end of said telescoping rod away from said wall for attaching said rod to a suspension device, wherein said telescoping rod is supported at said end away from said wall so that said telescoping rod may be extended and supported by said attaching means and hangers stored thereon may slide along the rod for easy access and removal of the hangers.

2. A travel garment bag according to claim 1, further comprising a second attaching means for attaching the end of said rod connected to the wall of said bag to said suspension device.

3. A traveling garment bag according to claim 2, further comprising a clip for holding said first and said second attaching means together.

4. A travel garment bag according to claim 2, wherein said first and said second attaching means extend at an angle toward the center of the bag.

5. A travel garment bag according to claim 1, wherein said removable opening is a zippered opening.

6. A travel garment bag according to claim 3, wherein said zippered opening encompasses most of the area of one side of said garment bag.

7. A travel garment bag according to claim 1, wherein said attaching means is rotatable.

8. A travel garment bag according to claim 1, further comprising a support means for connecting said rod to said covering means.

9. A garment bag comprising:

a fabric covering having an opening;

a telescoping rod connected to at least one wall of the fabric covering which is collapsible to fit within the bag and which extends to be much longer than the thickness dimension of the garment bag, said rod receiving hangers for supporting garments;

a hook connected to the end of the telescoping rod which extends away from the garment bag for attaching said rod to a clothes pole so that said telescoping rod may be extended with the hook supporting the extended end so that said hangers may slide along the rod for easy access and removal.

* * * * *